US007768491B2

(12) United States Patent
Han

(10) Patent No.: US 7,768,491 B2
(45) Date of Patent: Aug. 3, 2010

(54) APPARATUS AND METHOD FOR DRIVING LIQUID CRYSTAL DISPLAY DEVICE

(75) Inventor: Sang Soo Han, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 1112 days.

(21) Appl. No.: 11/410,487

(22) Filed: Apr. 25, 2006

(65) Prior Publication Data

US 2006/0291284 A1 Dec. 28, 2006

(30) Foreign Application Priority Data

Jun. 9, 2005 (KR) ..... 10-2005-0049232

(51) Int. Cl.
*G09G 3/36* (2006.01)

(52) U.S. Cl. ..... 345/98; 345/99

(58) Field of Classification Search ..... 345/101, 345/102, 98, 99

See application file for complete search history.

(56) References Cited

U.S. PATENT DOCUMENTS 6,839,048 B2 * 1/2005 Park ..... 345/102
2003/0231158 A1 * 12/2003 Someya et al. ..... 345/101

* cited by examiner

*Primary Examiner*—Amare Mengistu
*Assistant Examiner*—Joseph G Rodriguez
(74) *Attorney, Agent, or Firm*—Brinks Hofer Gilson & Lione

(57) ABSTRACT

An apparatus for driving a liquid crystal display device includes a liquid crystal panel having a plurality of gate lines and a plurality of data lines, a gate driver, a data driver, a data converter, and a timing controller. The timing controller controls the drive time of the gate and data lines, and generates a content data signal that is supplied to the data converter. The data converter processes the received content data signal, detects whether the content data signal corresponds to a moving or non-moving image, and outputs a modulated data signal to increase or decrease the response speed of a liquid crystal. The type of modulated data signal output from the data converter depends on whether the data converter detects a moving or non-moving image. A data driver receives the modulated data signal and converts the signal into a video signal that is supplied to the data lines.

4 Claims, 7 Drawing Sheets

APPARATUS AND METHOD FOR DRIVING LIQUID CRYSTAL DISPLAY DEVICE

PRIORITY CLAIM

This application claims the benefit of Korean Patent Application No. P2005-49232, filed on Jun. 9, 2005, which is hereby incorporated by reference as if fully set forth herein.

BACKGROUND OF THE INVENTION

1. Field of the Invention

The present invention relates to an apparatus for driving a liquid crystal display device, and more particularly, to an apparatus and method for driving a liquid crystal display device, wherein the response speed of a liquid crystal can be increased only when displaying a moving image.

2. Related Art

Liquid crystal display devices adjust light transmittance of liquid crystal cells according to a video signal so as to display an image. An active matrix type liquid crystal display device has a switching element for every liquid crystal cell and is suitable for the display of a moving image. A thin film transistor (TFT) may be used as the switching element in the active matrix type liquid crystal display device.

However, a liquid crystal display device may have a relatively slow response speed due to characteristics such as the inherent viscosity and elasticity of a liquid crystal, as can be seen from the following Equations 1 and 2.

$$\tau_r \propto \frac{\gamma d^2}{\Delta\varepsilon|Va^2 - V_F^2|} \quad \text{[Equaiton 1]}$$

In equation 1, $\tau_r$ is a rising time when a voltage is applied to the liquid crystal. Va is the applied voltage, $V_F$ is a Freederick transition voltage at which liquid crystal molecules start to be inclined, d is a liquid crystal cell gap, and $\gamma$ is the rotational viscosity of the liquid crystal molecules.

$$\tau_F \propto \frac{\gamma d^2}{K} \quad \text{[Equation 2]}$$

In equation 2, $\tau_F$ is a falling time when the liquid crystal is returned to its original position owing to an elastic restoration force after the voltage applied to the liquid crystal is turned off, and K is the inherent elastic modulus of the liquid crystal.

In a twisted nematic (TN) mode liquid crystal display device, although the response speed of the liquid crystal may be different according to the physical properties and cell gap of the liquid crystal, rising times may be about 20 ms to about 80 ms and falling times may be about 20 ms to 30 ms. Because liquid crystal response speeds may be longer than one frame period (e.g., 16.67 ms according to the National Television Standards Committee (NTSC)) of a moving image, the response of the liquid crystal proceeds to the next frame before a voltage being charged on the liquid crystal reaches a desired level. This results in motion blurring in which an afterimage is left in the eyeplane.

FIG. 1 is a waveform diagram illustrating a data-dependent brightness variation in a related art liquid crystal display device. Some related art liquid crystal display devices cannot express a desired color and brightness for display of a moving image. In FIG. 1, when data VD is changed from one level to another level, the corresponding display brightness level BL is unable to reach a desired value due to a slow response speed of the liquid crystal display device. As a result, motion blurring occurs in the moving image, thereby causing degradation in contrast ratio and in display quality.

In order to solve the low response speed of the liquid crystal display device, U.S. Pat. No. 5,495,265 and PCT International Publication No. WO 99/09967 have proposed a method for modulating data according to a variation therein using a look-up table (hereinafter, referred to as a 'high-speed driving method'). This high-speed driving method is adapted to modulate data on the basis of a principle as shown in FIG. 2.

With reference to FIG. 2, the related art high-speed driving method includes modulating input data VD and applying the modulated data MVD to a liquid crystal cell to obtain a desired brightness level MBL. In this high-speed driving method, in order to obtain the desired brightness level corresponding to the luminance of the input data in one frame period, the response of a liquid crystal is rapidly accelerated by increasing $|Va^2-V_F^2|$ in Equation 1 on the basis of a variation in the input data.

In detail, the related art high-speed driving method generates a modulated data signal Mdata by comparing source data RGB of a previous frame Fn−1 with source data RGB of a current frame Fn, as shown in FIG. 3.

In FIG. 3, a related art high-speed driving apparatus includes a frame memory 43 storing the source data RGB of the current frame Fn input from a data bus line 42, and a look-up table 44 outputting the modulated data signal Mdata by comparing the source data RGB of the previous frame Fn−1 with the source data RGB of the current frame Fn.

The frame memory 43 stores the source data RGB of the current frame Fn for one frame period, and supplies the stored source data RGB to the look-up table 44. The look-up table 44 provides a modulated data signal for accelerating the response speed of the liquid crystal on the basis of variation of the previous frame Fn−1 and the current frame Fn. Thus, the look-up table 44 compares the source data RGB of the current frame Fn input from the data bus line 42 with the source data RGB of the previous frame Fn−1 input from the frame memory 43 and selects modulated data Mdata corresponding to the comparison result.

Accordingly, the liquid crystal display device using the related art high-speed driving method can compensate for a slow response of a liquid crystal by modulation of a data value to relax motion blurring in a moving image, so as to display an image with a desired color and brightness.

However, the liquid crystal display device using the related art high-speed driving method improves picture quality by relaxing motion blurring for the display of a moving image but increases power consumption by accelerating the response speed of the liquid crystal even in the case of a general image or a still image (text) in addition to the moving image.

SUMMARY OF THE INVENTION

An apparatus for driving a liquid crystal display device includes a liquid crystal panel having a plurality of gate lines and a plurality of data lines, which define liquid crystal cell areas; a gate driver; a data driver; a data converter; and a timing controller. The timing controller controls the drive time of the gate and data lines, and generates a content data signal that is supplied to the data converter. The data converter processes the received content data signal, detects whether the content data signal corresponds to a moving or non-moving image, and outputs a modulated data signal to increase or decrease the response speed of a liquid crystal. The type of modulated data signal output from the data converter depends on whether the data converter detects a moving or non-moving image. A data driver receives the modulated data signal and converts the modulated data signal into a video signal that is supplied to the data lines.

Alternatively, the timing controller may generate a time data signal that time divides a time frame into a first period and a second period. During the first period, the data converter may output a modulated data signal. During the second period the data converter may output the received content data signal.

A method of driving a liquid crystal display device includes receiving a data signal, detecting whether the data signal corresponds to a moving or non-moving image, generating a modulated data signal that increases or decreases the response speed of a liquid crystal in response to the detected type of input signal, and converting the modulated data signal into a video signal that may be applied to a plurality of data lines. comparing a data signal of a current frame to a data signal of a previous frame to detect Other systems methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
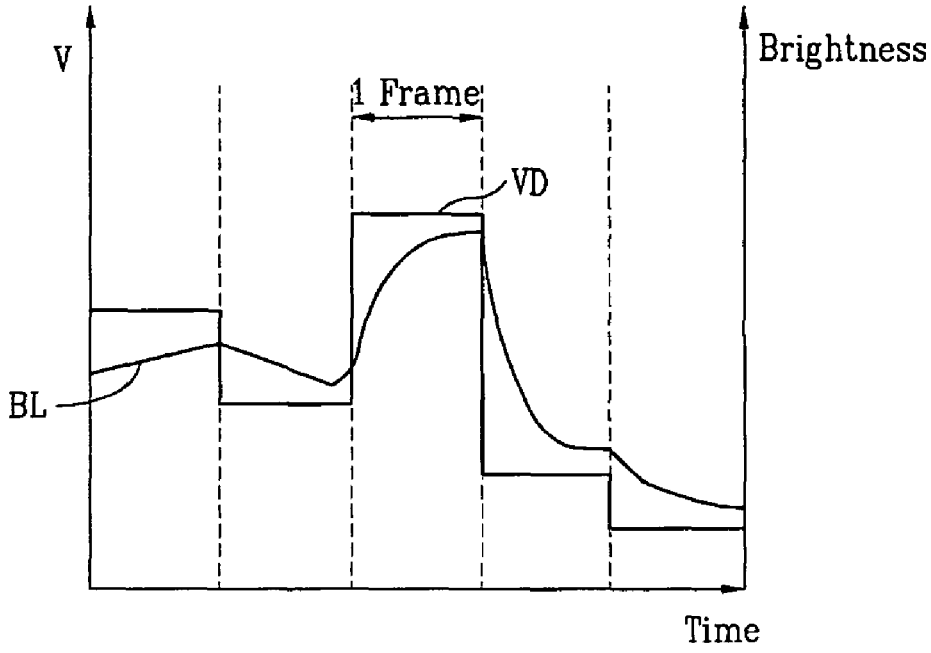
FIG. 1 is a waveform diagram illustrating a data-dependent brightness variation in a related art liquid crystal display device.
Figure 2:
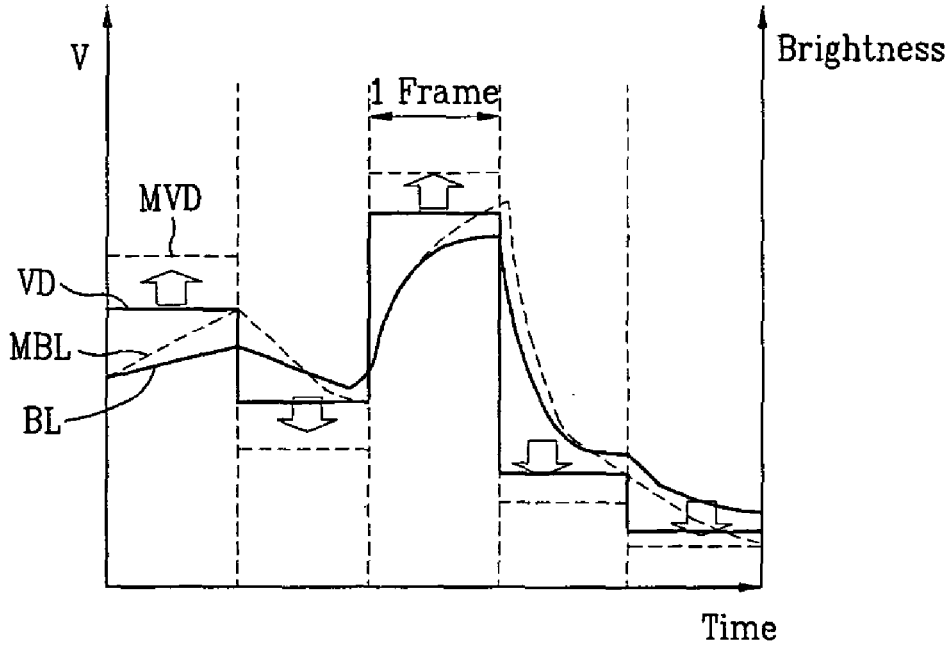
FIG. 2 is a waveform diagram illustrating a data modulation-dependent brightness variation in a related art high-speed driving method of a liquid crystal display device.
Figure 3:
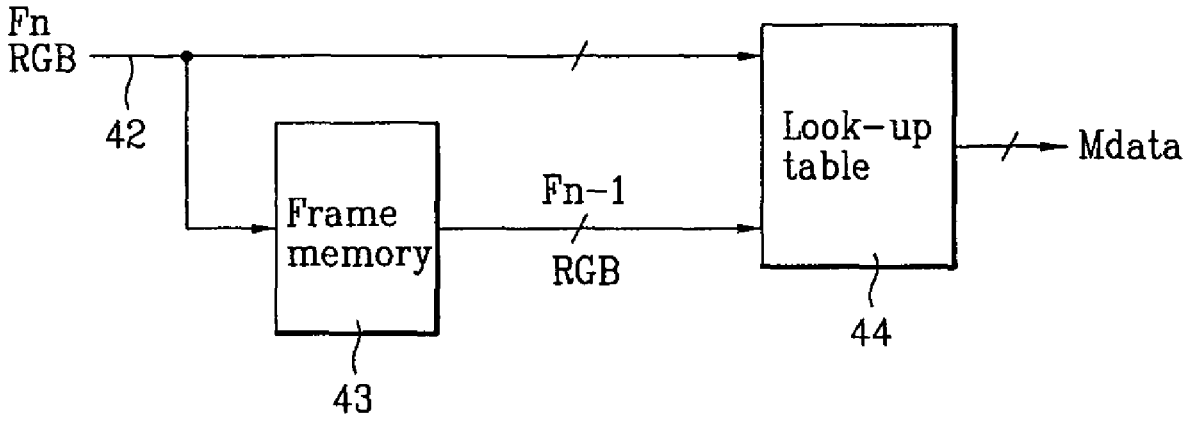
FIG. 3 is a block diagram illustrating a related art high-speed driving apparatus.
Figure 4:
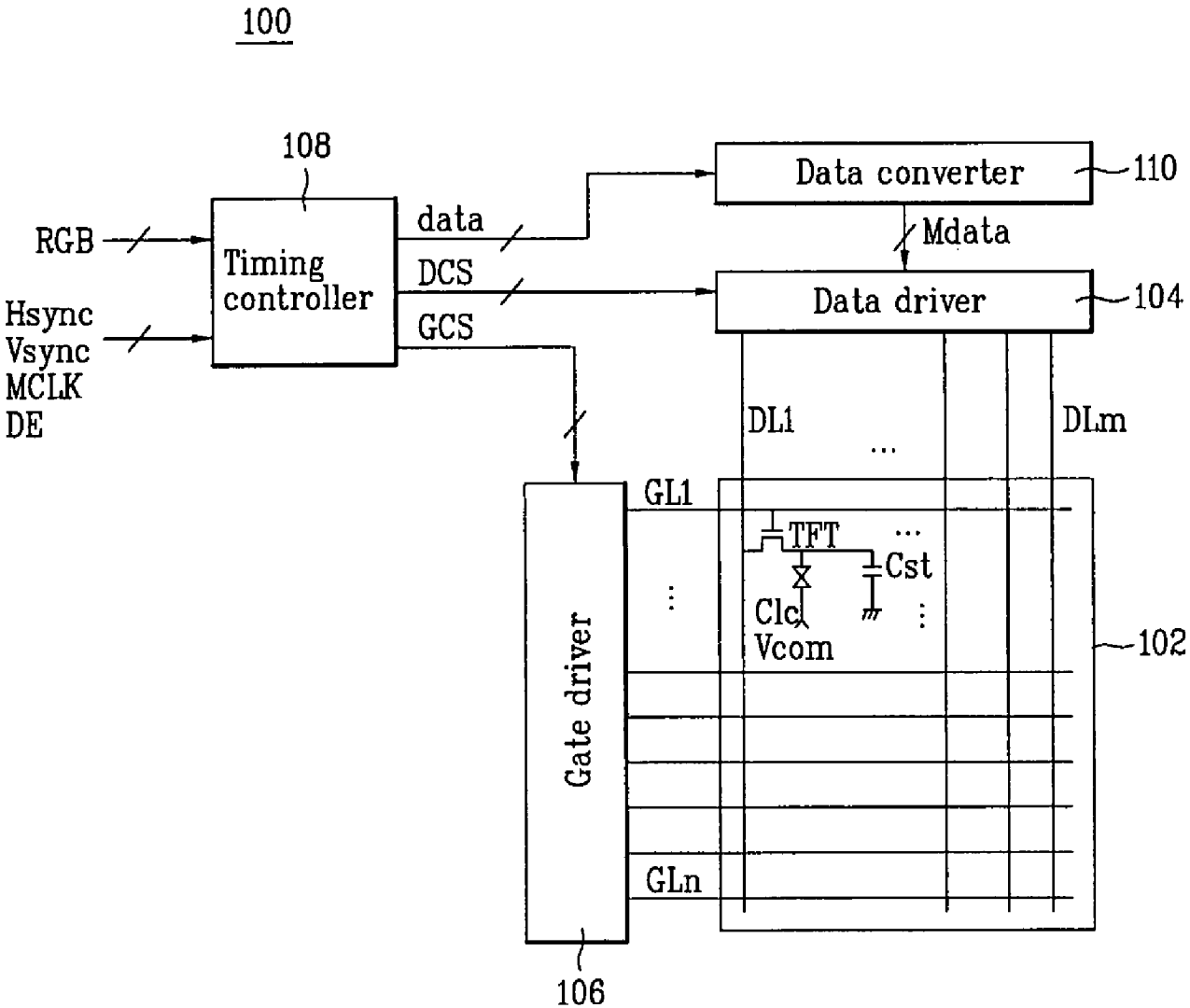
FIG. 4 is a diagram of an apparatus for driving a liquid crystal display device.

FIG. 4 is a diagram of an apparatus that drives a liquid crystal display device 100. In FIG. 4, the apparatus 100 includes a liquid crystal panel 102 having a plurality of gate lines GL1 to GLn and a plurality of data lines DL1 to DLm. The gate lines may be arranged to cross the data lines to define liquid crystal cell areas. A gate driver 106 coupled to the gate lines drives gate lines GL1 to GLn. A data converter 110 receives input data signal data, and generates a modulated data signal, Mdata, which may increase or decrease the response speed of a liquid crystal. Data driver 104 converts the modulated data signal, Mdata, into an analog video signal which is supplied to the respective data lines DL1 to DLm. Timing controller 108 controls a driving time of the data and gate drivers 104 and 106, and supplies the data signal to the data converter 110.

In FIG. 4, liquid crystal panel 102 includes a TFT in the liquid crystal cell areas where the respective gate lines GL1 to GLn cross the respective data lines DL1 to DLm. The TFT of a particular liquid crystal cell area is connected to the respective gate lines GL1 to GLn and respective data lines DL1 to DLm. The TFT supplies an analog video signal from the data lines DL1 to DLm in response to gate pulses from the gate lines GL1 to GLn. The liquid crystal cell is comprised of common electrodes facing each other with liquid crystal therebetween. Additionally, the electrodes are connected to the TFT. Therefore, the liquid crystal cell is equivalent to a liquid crystal capacitor Clc. The liquid crystal cell includes a storage capacitor Cst that maintains the analog video signal charged in the liquid crystal capacitor Clc until the next analog video signal is charged therein.

Timing controller 108 uses externally input RGB source data to generate data signal data that may be supplied to data converter 110. The supplied data signal data may be used to drive liquid crystal panel 102. To control the drive timing of data driver 104 and gate drive 106, timing controller 108 generates data control signals, DCS, and gate control signals, GCS, using a main clock signal, MCLK, a data enable signal, DE, and horizontal and vertical synchronizing signals, Hsync and Vsync. In FIG. 4, the signals used to generate the DCS and GCS signals are externally input to timing controller 108.

Using the gate control signals from timing controller 108, gate driver 106 generates gate pulses for turning the TFT on and off. The gate pulse may be sequentially generated. Gate control signals may include a gate start pulse, GSP, a gate shift clock, GSC, and a gate output enable GOE signal. Gate pulses may include a gate high voltage, VGH, for turning the TFT on, and a gate low voltage, VGL for turning the TFT off. The gate pulses may be sequentially supplied to gate lines GL1 to GLn by gate driver 106.

Data converter 110 may increase or decrease a liquid crystal's response speed by generating a modulated signal, Mdata, in response to the data signal data received from timing controller 108. Although shown as separate from timing controller 108 in FIG. 4, data converter 110 may be integrated into or a unitary part of timing controller 108.

In response to the data control signals, DCS, data driver 104 converts the modulated data signal Mdata into an analog video signal. The analog video signal corresponding to one horizontal line per one horizontal period is supplied to the data lines DL1 to DLm during which the scan pulses are supplied into the gate lines GL1 to GLn. Therefore, data driver 104 selects one of a plurality of gamma voltages depending on a gray level value of the modulated data signal Mdata and supplies the selected gamma voltage to the data lines DL1 to DLm.

Figure 5:
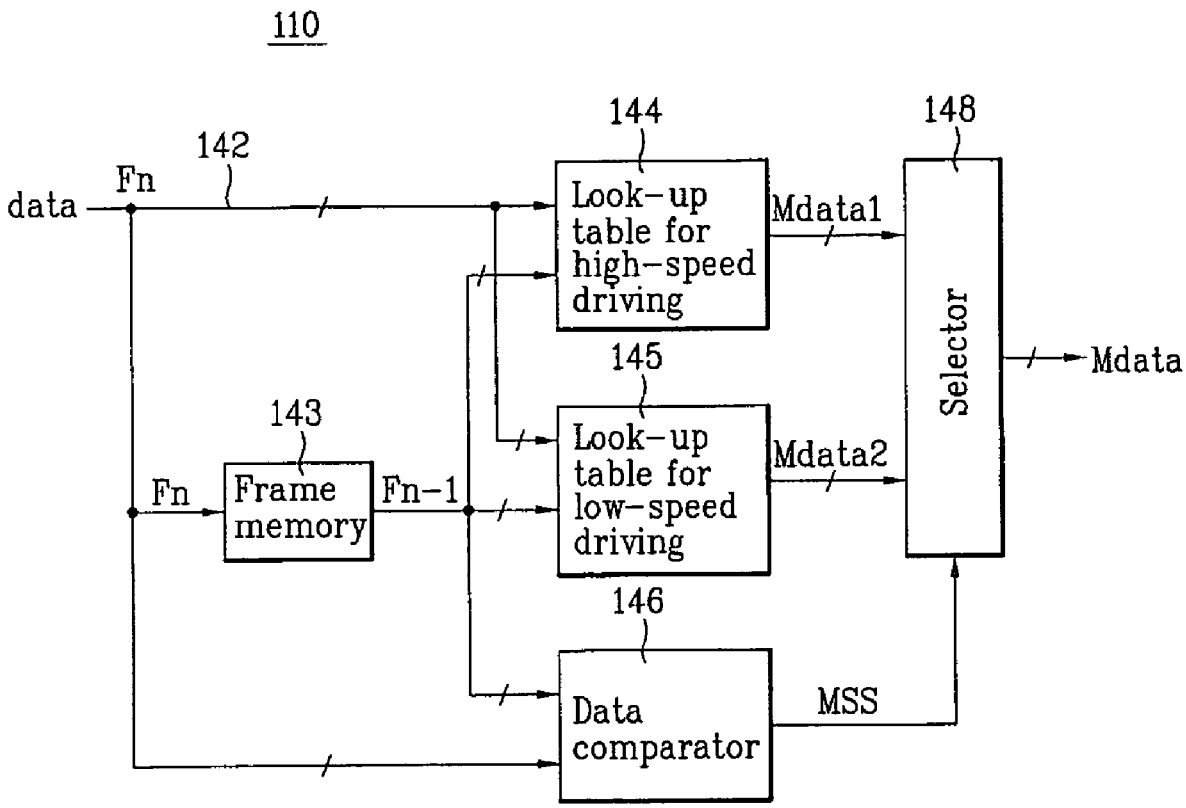
FIG. 5 is a block diagram of a data converter.

FIG. 5 is a block diagram of data converter 110. In FIG. 5, data converter 110 includes a frame memory 143, a high-speed driving look-up table 144, a low-speed driving look-up table 146, and a data comparator 146. Frame memory 143 stores data signal data supplied from data bus line 142 for one frame period. Frame memory 143 also supplies previously stored data signal data to high-speed driving look-up table 144, low-speed driving look-up table 145, and data comparator 146.

Figure 6:
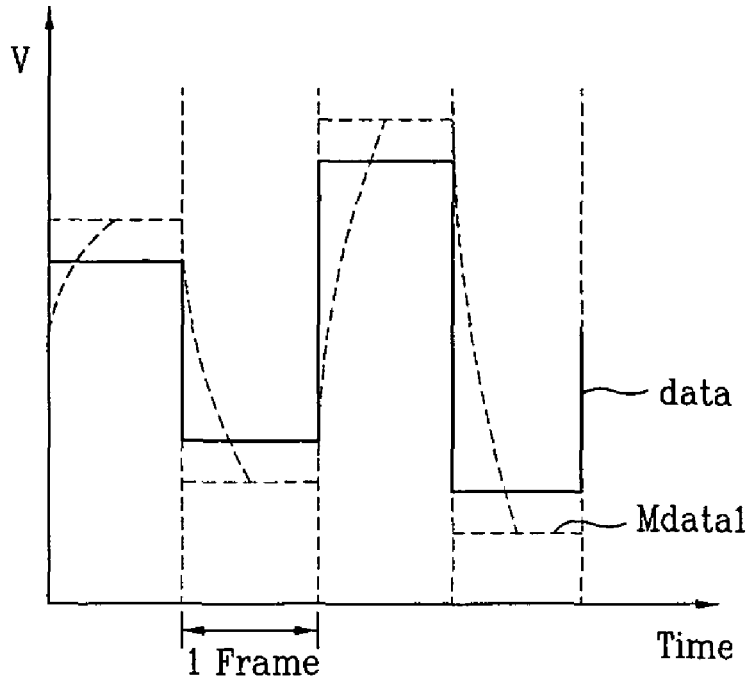
FIG. 6 is a waveform diagram illustrating brightness variation dependent upon modulated data for high-speed driving using the data converter of FIG. 5.

High-speed driving look-up table 144 compares the data signal data of the current frame Fn, input from the data bus line 142, with the data signal data of the previous frame Fn−1, input from the frame memory 143. Based on the variation of the previous frame Fn−1 and the current frame Fn, high-speed driving look-up table 144 may provide modulated data Mdata1 for high-speed driving. Mdata1 may then be supplied to selector 148. Modulated data signal Mdata1 may be used to accelerate the response speed of a liquid crystal. For instance, as shown in FIG. 6, the response speed of a liquid crystal is increased because the Mdata1 signal has a larger voltage than that of the current frame Fn.

Figure 7:
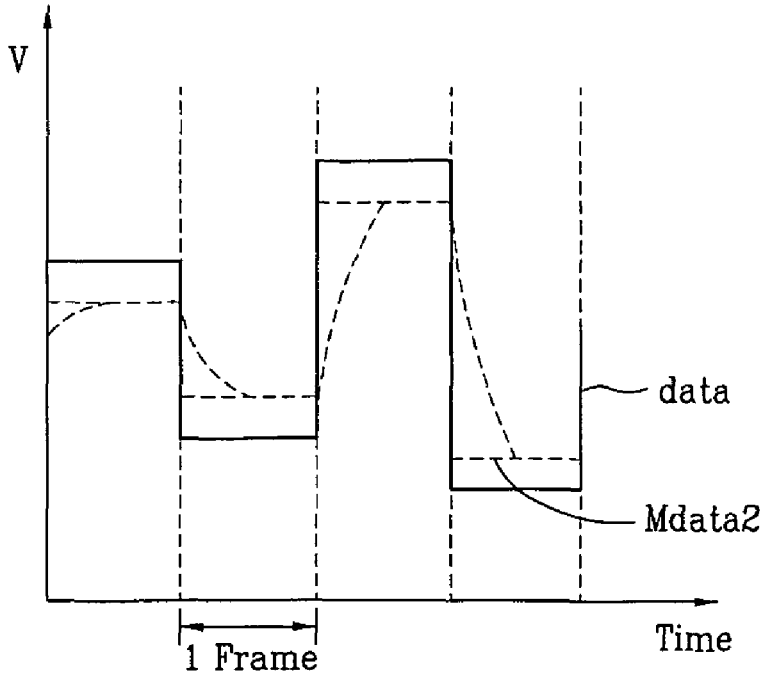
FIG. 7 is a waveform diagram illustrating brightness variation dependent upon modulated data for low-speed driving using the data converter of FIG. 5.

Low-speed driving look-up table 145 compares the data signal of the current frame Fn, input from the data bus line 142, with the data signal data of the previous frame Fn−1, input from the frame memory 143. Based on the variation of the previous frame Fn−1 and the current frame Fn, low-speed driving look-up table 145 may provide modulated data signal Mdata2 for low-speed driving. Mdata2 may then be supplied to selector 148. Modulated data signal Mdata2 may be used to decelerate the response speed of a liquid crystal. For instance, as shown in FIG. 7, the response speed of a liquid crystal is decreased because the Mdata2 signal has a lower voltage than that of the current frame Fn.

Data comparator 146 compares the data signal data of the current frame Fn with the data signal data of the previous frame Fn−1 to detect whether the data signal is a moving image data signal or a still image data signal. Based on the type of data signal detected, data comparator 146 generates a mode selection signal MSS. Data comparator 146 may detect variations of the current frame Fn data signal on the basis of the previous frame Fn−1 data signal. If the detected variation is greater than a reference value, data comparator 146 generates a first mode selection signal MSS corresponding to a moving image data signal. If a still image is detected, a second mode selection signal MSS corresponding to the still image data signal may be generated by data comparator 146. The still image may be a text image or a general image, whose movement is smaller than that of the moving image.

If the first mode selection signal MSS is supplied from data comparator 146, selector 148 selects the high-speed driving modulated data signal, Mdata1, as the modulated data signal Mdata to be output from data converter 110. Alternatively, if the second mode selection signal MSS is supplied from data comparator 146, selector 148 selects the low-speed driving modulated data signal, Mdata2, as the modulated data signal Mdata to be output from data converter 110.

A method of driving a liquid crystal display device including data converter 110 includes storing the data signal data, Fn, of one frame input through the data bus line 142 in frame memory 143 of data converter 110. Data converter 110 compares the data signal data of the previously stored frame, Fn−1, with the data signal data of the current frame Fn to detect whether the data signal data of the current frame Fn is a moving image or a still image. Based on the comparison result, any one of the first and second mode selection signals MSS may be generated.

At substantially the same time, the data converter 110 generates the modulated data signal Mdata1 for high-speed driving and the modulated data signal Mdata2 for low-speed driving using the data signal data of the previous frame Fn−1 stored in the frame memory 143 and the data signal of the current frame Fn. Data converter 110 selects any one of the modulated data signal Mdata1 for high-speed driving and the modulated data signal Mdata2 for low-speed driving in response to the first or second mode selection signals MSS, and supplies the selected modulated data signal to the data driver 104. Data driver 104 converts the modulated data signal Mdata supplied from the data converter 110 into an analog video signal in response to the first and second mode selection signals MSS and supplies the analog video signal to each of the data lines DL1 to DLm of the liquid crystal panel 102.

As a result, if the data signal data of the current frame Fn corresponds to a moving image, it is possible to relax motion blurring by accelerating the response speed of the liquid crystal, as shown in FIG. 6, using the modulated data signal Mdata1 for high-speed driving. Additionally, when the data signal of the current frame Fn corresponds to a general image, such as a non-moving image, it is possible to reduce power consumption by decelerating the response speed of the liquid crystal, as shown in FIG. 7, using the modulated data signal Mdata2 for low-speed driving.

Figure 8:
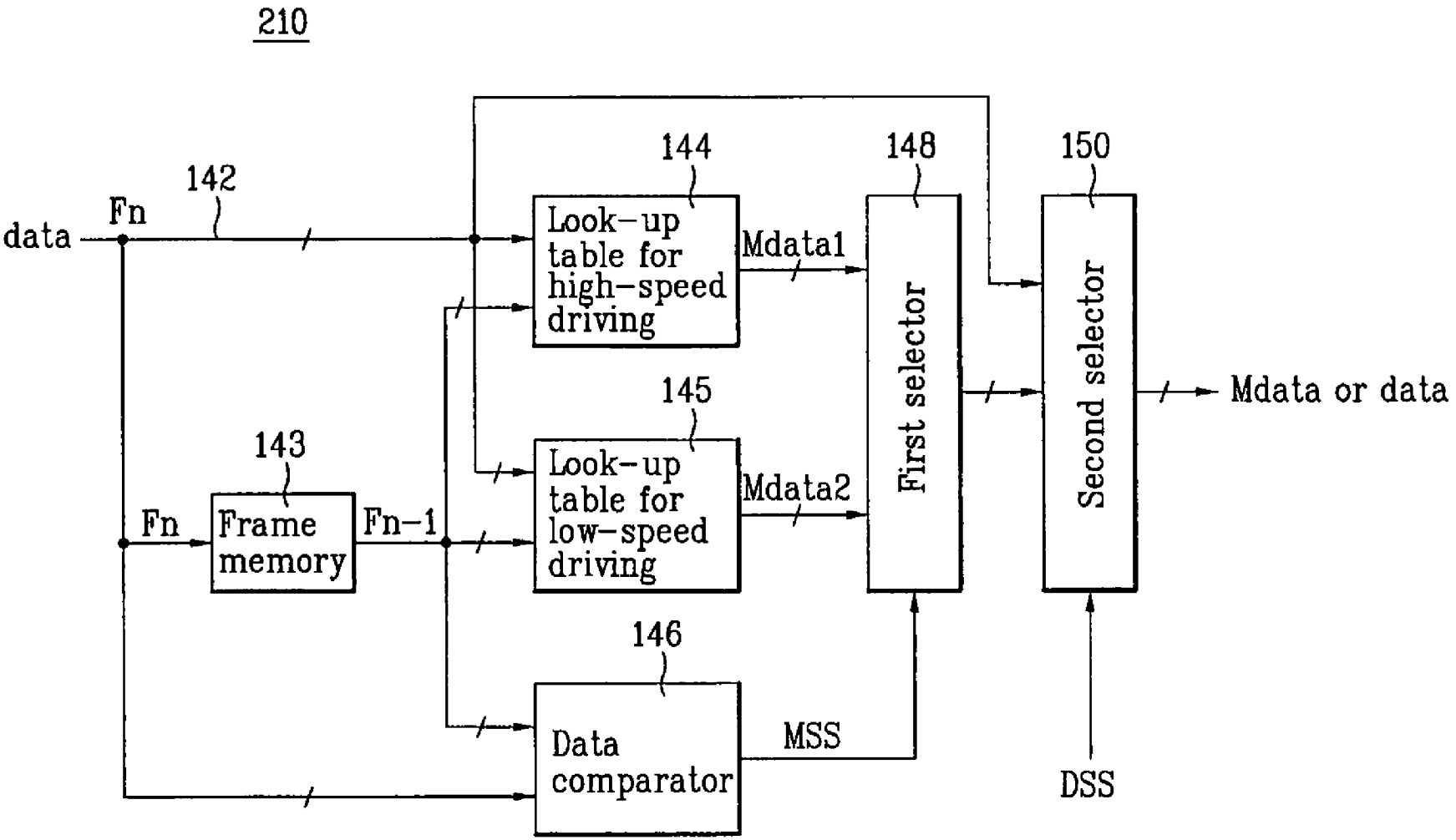
FIG. 8 is a block diagram of an alternate data converter.

FIG. 8 is a block diagram of an alternate data converter used in an apparatus that drives a liquid crystal display device. In FIG. 8, data converter 210 includes a second selector 150. Second selector 150 receives as input data signal data of the current frame Fn, the modulated data signal Mdata1 or Mdata2, from first selector 148, and a data selection signal DSS. Based on the data selection signal, second selector 150 may sequentially output the selected Mdata signal (Mdata1 or Mdata2) and data signal data of the current frame, Fn.

First selector 148 selects the high-speed driving modulated data signal Mdata1, which is output from the high-speed driving look-up table 144, as the modulated data signal Mdata if the first mode selection signal MSS is supplied from the data comparator 146. Alternatively, first selector 148 selects the low-speed driving modulated data signal Mdata2, which is output from the low-speed driving look-up table 145, as the modulated data signal Mdata if the second mode selection signal MSS is supplied from the data comparator 146. The modulated data signal selected by first selector 148 is supplied to second selector 150.

Second selector 150 is supplied with the high-speed driving modulated data signal Mdata1 or the low-speed modulated data signal Mdata2 from the first selector, and the data signal data of the current frame Fn from the data bus line 142. Second selector 150 selectively outputs any one of the high-speed driving modulated data signal Mdata1 or the low-speed driving modulated data signal Mdata2 in response to a data selection signal DSS, and then selectively outputs the data signal data of the current frame Fn.

To provide the sequential outputs from second selector 150, the data selection signal DSS may be time-divided for one frame by timing controller 108. Accordingly, the data selection signal DSS may have a first logic level at a first period corresponding to the first half of one frame, and a second logic level at a second period corresponding to the second half of the frame. The second logic level of the data selection signal DSS is different from the first logic level and corresponds to the second half of one frame. The first period and the second period may be equal to or different from each other.

Thus, the second selector 150 receives the modulated data signal Mdata1 or Mdata2 from the first selector 148 for the first period of one frame in response to the first logic level of the data selection signal DSS, and supplies the modulated data signal to the data driver 104. Also, the second selector 150 selects the data signal data of the current frame Fn from the data bus line 142 for the second period of one frame in response to the second logic level of the data selection signal DSS and supplies the selected data signal data to the data driver 104. Since the selected modulated data signal (Mdata1 or Mdata2) may be at a higher or smaller level than the data signal data of the current frame, the output from second selector 150 which is supplied to data driver 104 may comprise a stepped or stair shaped output.

Data driver 104 converts the modulated data signal (Mdata1 or Mdata2) from the data converter 110 into an analog video signal for the first period of one frame and supplies the analog video signal to the respective data lines. Afterwards, the data driver 104 converts the data signal data of the current frame Fn from the data converter 110 into an analog video signal for the second period of one frame and supplies the analog video signal to the respective data lines.

A method of driving a liquid crystal display device including alternate data converter 210 includes storing the data signal data, Fn, of one frame input through the data bus line 142 in frame memory 143 of data converter 210. Data converter 210 compares the data signal data of the previously stored frame Fn−1 with the data signal data of the current frame Fn to detect whether the data signal data of the current frame Fn is a moving image or a still image. Based on the comparison result, any one of the first or second mode selection signals MSS may be generated.

At substantially the same time, data converter 210 generates the modulated data signal Mdata1 for high-speed driving and the modulated data signal Mdata2 for low-speed driving using the data signal data of the previous frame Fn−1 stored in the frame memory 143 and the data signal data of the current frame Fn. Data converter 210 selects any one of the modulated data signal Mdata1 for high-speed driving or the modulated data signal Mdata2 for low-speed driving using the first selector 148 in response to the first and second mode selection signals MSS. Also, the data converter 210 supplies the selected modulated data signal Mdata selected by the first selector 148 to data driver 104 for the first period of one frame using the second selector 150 in response to the data selection signal DSS, and then supplies the data signal data of the current frame Fn to the data driver 104 for the second period of one frame.

Data driver 104 converts the modulated data signal Mdata supplied from the data converter 210 into the analog video signal for the first period of one frame in response to the data selection signal DSS and supplies the analog video signal to each of the data lines DL1 to DLm of the liquid crystal panel 102. Afterwards, the data driver 104 converts the data signal data of the current frame Fn supplied from the data converter 210 into the analog video signal for the second period of one frame and supplies the analog video signal to each of the data lines DL1 to DLm of the liquid crystal panel 102.

Figure 9:
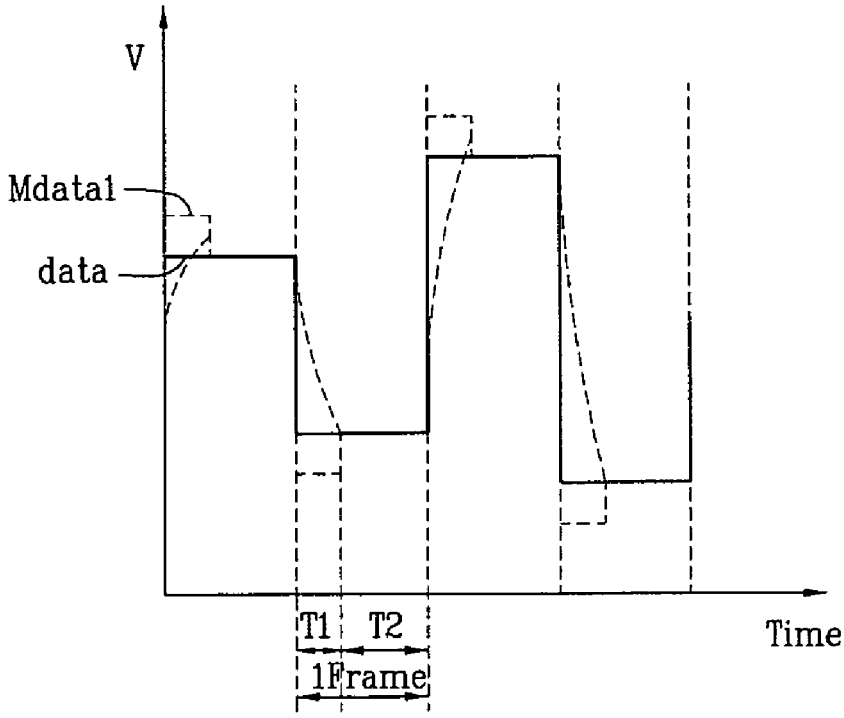
FIG. 9 is a waveform diagram illustrating brightness variation dependent upon modulated data for high-speed driving and a data signal of a current frame using the alternate data converter of FIG. 8.
Figure 10:
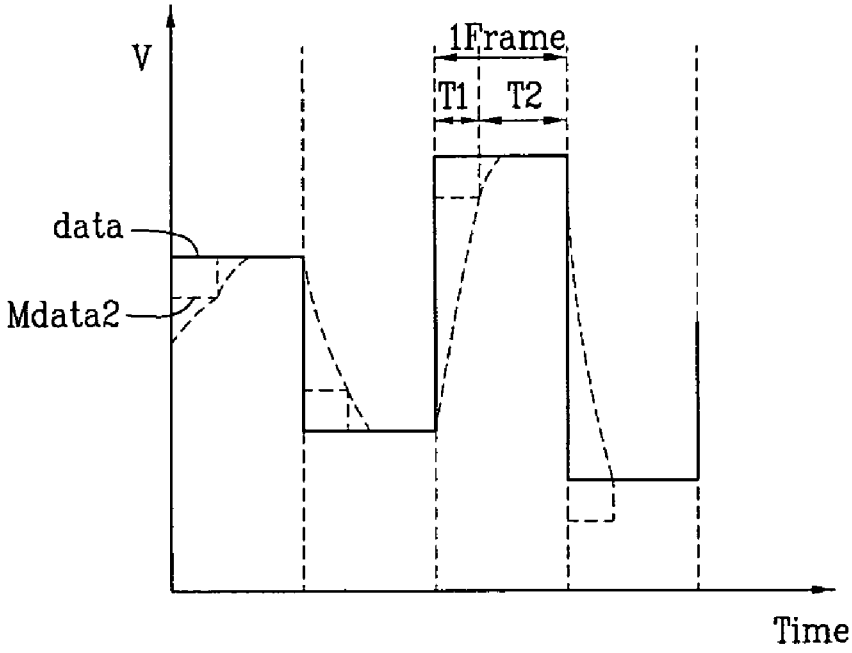
FIG. 10 is a waveform diagram illustrating brightness variation dependent upon modulated data for low-speed driving and a data signal of a current frame using the alternate data converter of FIG. 8.

As a result, if the data signal data of the current frame Fn is a moving image, it is possible to relax motion blurring by driving the liquid crystal using the actual data signal data for the second period of one frame after accelerating the response speed of the liquid crystal for the first period T1 of one frame using the modulated data signal Mdata1 for high-speed driving, as shown in FIG. 9. Additionally, if the data signal data of the current frame Fn is a general signal, such as a non-moving image, it is possible to reduce power consumption by driving the liquid crystal using the actual data signal data for the second period of one frame after decelerating the response speed of the liquid crystal using the modulated data signal Mdata2 for low-speed driving, as shown in FIG. 10.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An apparatus for driving a liquid crystal display device, comprising:

a liquid crystal panel having a plurality of gate lines and a plurality of data lines, the gate lines being arranged to cross the data lines to define liquid crystal cell areas comprising a liquid crystal;

a gate driver driving the gate lines;

a data driver driving the data lines;

a data converter coupled to the data driver, generating a modulated data for increasing or decreasing a response speed of the liquid crystal in response to an input data; and a timing controller controlling a driving time of the data and gate drivers and supplying data signal to the data converter;

where the data driver converts the modulated data into an analog video signal to supply it to the respective data lines, where the data converter comprises:

a memory storing the input data for a unit of a frame;

a first look-up table generating a first modulated data for increasing the response speed of the liquid crystal, in response to the input data of a current frame supplied from the timing controller and data of a previous frame supplied from the memory, where the first modulated data comprises a modulated data with a magnitude larger than a magnitude of the input data;

a second look-up table generating a second modulated data for decreasing the response speed of the liquid crystal, in response to the input data of the current frame and the data of the previous frame, where the second modulated data comprises a modulated data with a magnitude smaller than a magnitude of the input data;

a data comparator comparing the input data of the current frame with the data of the previous frame to generate a mode selection signal for indicating a moving image or non-moving image; and a first selector that selects the first modulated data in response to the mode selection signal indicating the moving image or selects the second modulated data in response to the mode selection signal indicating the non-moving image, and outputs the selected first or second modulated data signal to the data driver, where the timing controller is configured to generate a data selection signal that time-divides one frame into a first and a second period, and supplies the data selection signal to the data converter, where the data converter further comprises:

a second selector configured to supply the first or second modulated data to the data driver for the first period in response to the data selection signal, and then supply the input data of the current frame to the data driver for the second period, where the data driver converts the modulated data into the analog video signal to supply it to the respective data lines for the first period, and then converts the input data of the current frame into an analog video signal to supply it to the respective data lines for the second period.

2. The apparatus of claim 1, where the timing controller includes the data converter.

3. An apparatus that drives a liquid crystal display device, comprising:

a memory storing the input data for a unit of a frame;

a first look-up table generating a first modulated data for increasing the response speed of the liquid crystal, in response to the input data of a current frame and data of a previous frame supplied from the memory, where the first modulated data comprises a modulated data with a magnitude larger than a magnitude of the input data;

a second look-up table generating a second modulated data for decreasing the response speed of the liquid crystal, in response to the input data of the current frame and the data of the previous frame, where the second modulated data comprises a modulated data with a magnitude smaller than a magnitude of the input data;

a data comparator comparing the input data of the current frame with the data of the previous frame to generate a mode selection signal for indicating a moving image or non-moving image;

a first selector that selects the first modulated data in response to the mode selection signal indicating the moving image or the second modulated data in response to the mode selection signal indicating the non-moving image; and a second selector that selects the modulated data from the first selector for the first period, and then selects the input data of the current frame for the second period.

4. A method of driving a liquid crystal display device including a liquid crystal panel having a plurality of gate lines and a plurality of data lines, the gate lines being arranged to cross the data lines to define liquid crystal cell areas comprising a liquid crystal, comprising:

generating a first modulated data for increasing a response speed of the liquid crystal in response to an input data of a current frame and data of a previous frame, where the first modulated data comprises a modulated data with a magnitude larger than a magnitude of the input data of the current frame;

generating a second modulated data for decreasing a response speed of the liquid crystal in response to the input data of the current frame and the data of the previous frame, where the second modulated data comprises a modulated data with a magnitude smaller than a magnitude of the input data of the current frame;

comparing the input data of the current frame with data of the previous frame to detect a moving image or non-moving image;

selecting the first modulated data when the moving image or the second modulated data when the non-moving image;

time-dividing a frame into first and second periods;

selecting the modulated data to supply it to the respective data lines for the first period; and selecting the input data of the current frame to supply it to the respective data lines for the second period.

* * * * *